US007234957B2

(12) United States Patent
Wang

(10) Patent No.: US 7,234,957 B2
(45) Date of Patent: Jun. 26, 2007

(54) ELECTRICAL CONNECTOR ASSEMBLY HAVING LOCKING MECHANISM

(75) Inventor: Shi-Yong Wang, Shenzhen (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/304,512

(22) Filed: Dec. 14, 2005

(65) Prior Publication Data

US 2006/0128192 A1 Jun. 15, 2006

(30) Foreign Application Priority Data

Dec. 14, 2004 (CN) ..... 2004 1 0066076

(51) Int. Cl.
*H01R 13/627* (2006.01)

(52) U.S. Cl. ..... 439/353

(58) Field of Classification Search ..... 439/352–354, 439/357, 78, 79, 660
See application file for complete search history.

(56) References Cited

U.S. PATENT DOCUMENTS 3,394,337 A * 7/1968 Miller ..... 439/353
6,164,990 A * 12/2000 Yu et al. ..... 439/135
6,908,323 B2 * 6/2005 Ice ..... 439/160
7,040,910 B2 * 5/2006 Nagata et al. ..... 439/352

* cited by examiner

*Primary Examiner*—Khiem Nguyen
(74) *Attorney, Agent, or Firm*—Wei Te Chung

(57) ABSTRACT

An electrical connector assembly (10) includes a first connector (20) and a second connector (30) for mating with the first connector. The first connector includes a first insulative housing (200) having a number of first conductive terminals (210). The second connector includes a second insulative housing (300) planted with a number of second conductive terminals (320) to contact with the corresponding first conductive terminals, respectively. The first insulative housing is provided with a pair of hooks (220) at two sides thereof. The second connector is formed with a pair of protruding blocks (314) in compliance with the hooks so as to safely lock the hooks when the first connector is fully mated with the second connector.

18 Claims, 5 Drawing Sheets

ELECTRICAL CONNECTOR ASSEMBLY HAVING LOCKING MECHANISM

BACKGROUND OF THE INVENTION

1. Field of the Invention

The present invention relates to the art of electrical connector assemblies and, more particularly, to an electrical connector assembly having locking mechanism for forming stable electrical connection between two electrical interfaces, such as two circuit substrates.

2. General Background

Electrical connectors are generally provided in pairs, such as a first connector and a second connector for mating with the first connector, to connect terminating ends of circuit traces on different circuit substrates. Typically, the first connector includes a first insulative housing embedded with a plurality of first conductive terminals. The second connector includes a second insulative housing having a plurality of second conductive terminals received therein. In use, the first conductive terminals are brought to contact with the corresponding second conductive terminals, respectively, so as to form electrical connection therebetween.

In order to ensure reliable electrical connection between the first connector and the second connector, various of fastening mechanisms are provided. For instance, a pair of fastening blocks is formed at two sides of the first insulative housing of the first connector. A pair of fastening slots in compliance with the fastening blocks is defined in the second insulative housing of the second connector. When the first connector is fully mated with the second connector, the fastening blocks are held in the corresponding fastening slots to reinforce the mating of the first connector and the second connector.

However, the mating of the first connector and the second connector is realized via frictional intervention between the fastening blocks and the fastening slots. In use, the fastening block with slippery deformable surface is likely to disengage from the fastening slots, which may possibly adversely affects the electrical interconnection between the first connector and the second connector.

Therefore, there is a heretofore unaddressed need in the industry to address the aforementioned deficiencies and inadequacies.

SUMMARY

According to a preferred embodiment of the present invention, an electrical connector assembly for establishing electrical connection between two circuit substrates includes a first connector and a second connector for mating with the first connector. The first connector includes a first insulative housing having a number of first conductive terminals. The second connector includes a second insulative housing having a number of second conductive terminals to contact with the corresponding first conductive terminals, respectively. The first insulative housing is provided with a pair of hooks at two sides thereof. The second insulative housing is formed with a pair of protruding blocks in compliance with the hooks so as to safely lock the hooks when the first connector is fully mated with the second connector.

When the first connector is fully mated with the second connector, the protruding blocks of the second connector firmly lock the hooks of the first connector. Therefore, the first connector is securely mated with the second connector and free from disengaging from the second connector. Stable electrical performance of the electrical connector assembly is ensured.

Other advantages and novel features will be drawn from the following detailed description of a preferred embodiment with the attached drawings, in which:

DETAILED DESCRIPTION OF THE EMBODIMENT

Figure 1:
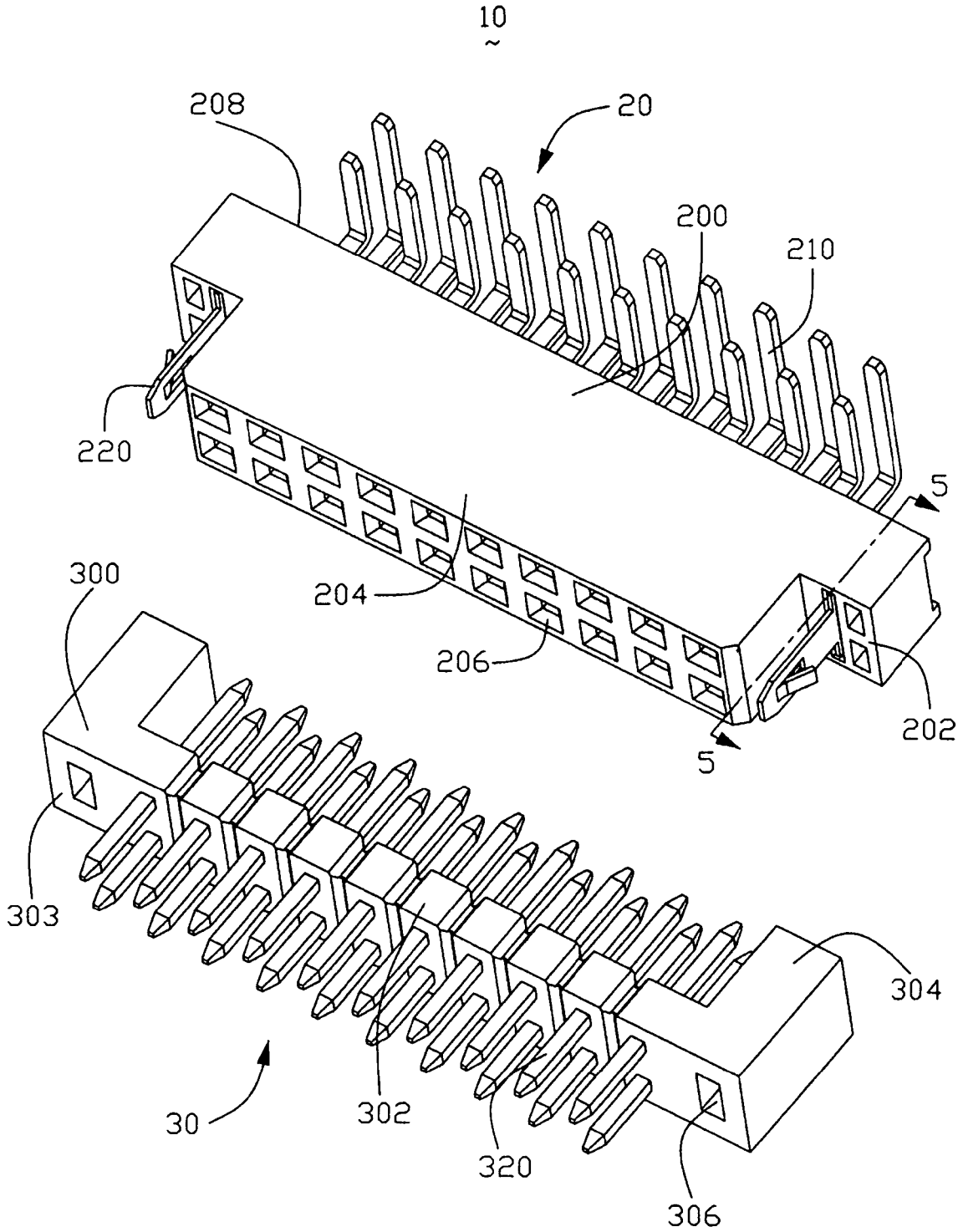
FIG. 1 depicts an exploded, isometric view of an electrical connector assembly including a first connector and a second connector in accordance with a preferred embodiment of the present invention.

Referring to FIG. 1, an electrical connector assembly 10 in accordance with a preferred embodiment of the present invention includes a first connector 20 and a second connector 30 to mate with the first connector 20.

The first connector 20 includes a first insulative housing 200, a plurality of first conductive terminals 210 residing within the first insulative housing 200, and a pair of hooks 220 disposed at two sides of the first insulative housing 200.

The first insulative housing 200 is molded from electrically insulating materials, such as resin or the alike. The first insulative housing 200 forms a pair of recessed step 202 at two opposite sides thereof and a middle protruding platform 204 extending upwardly with respect to the recessed steps 202. Two arrays of passages 206 extending throughout the middle protruding platform 204 are arranged in a matrix manner. A plurality of first conductive terminals 210 is received in the corresponding passages 206, respectively. One end of the first conductive terminal 210 extends out of a mounting surface 208 of the first insulative housing 200 to be electrically connected to a circuit substrate (not shown). The other end of the first conductive terminal 210 is forked in the passage 206 so as to engagingly receive a corresponding second conductive terminal 320 of the second electrical connector 30.

Figure 4:
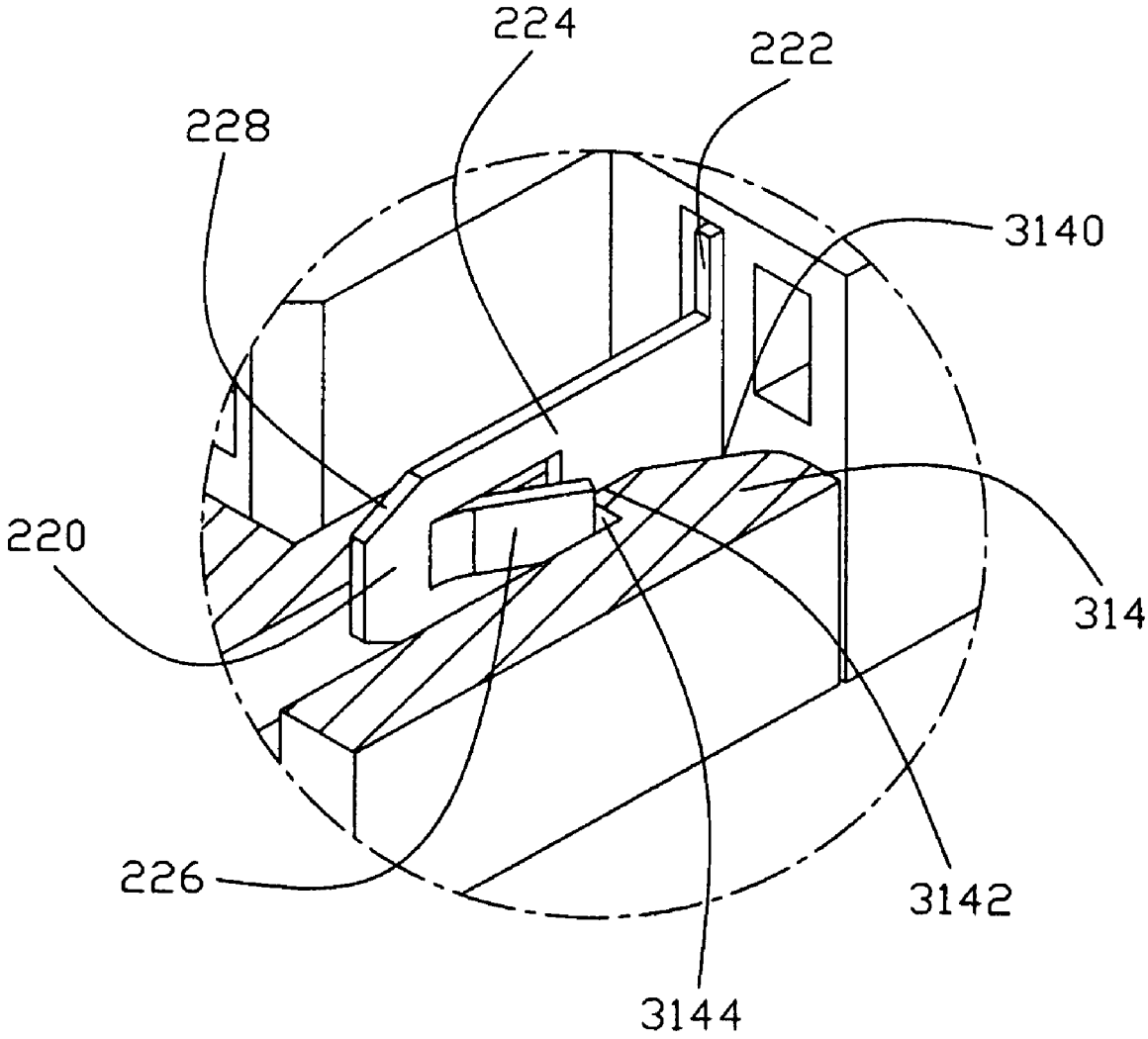
FIG. 4 depicts an enlarged view of a circled part 4 of the electrical connector assembly of FIG. 3.
Figure 5:
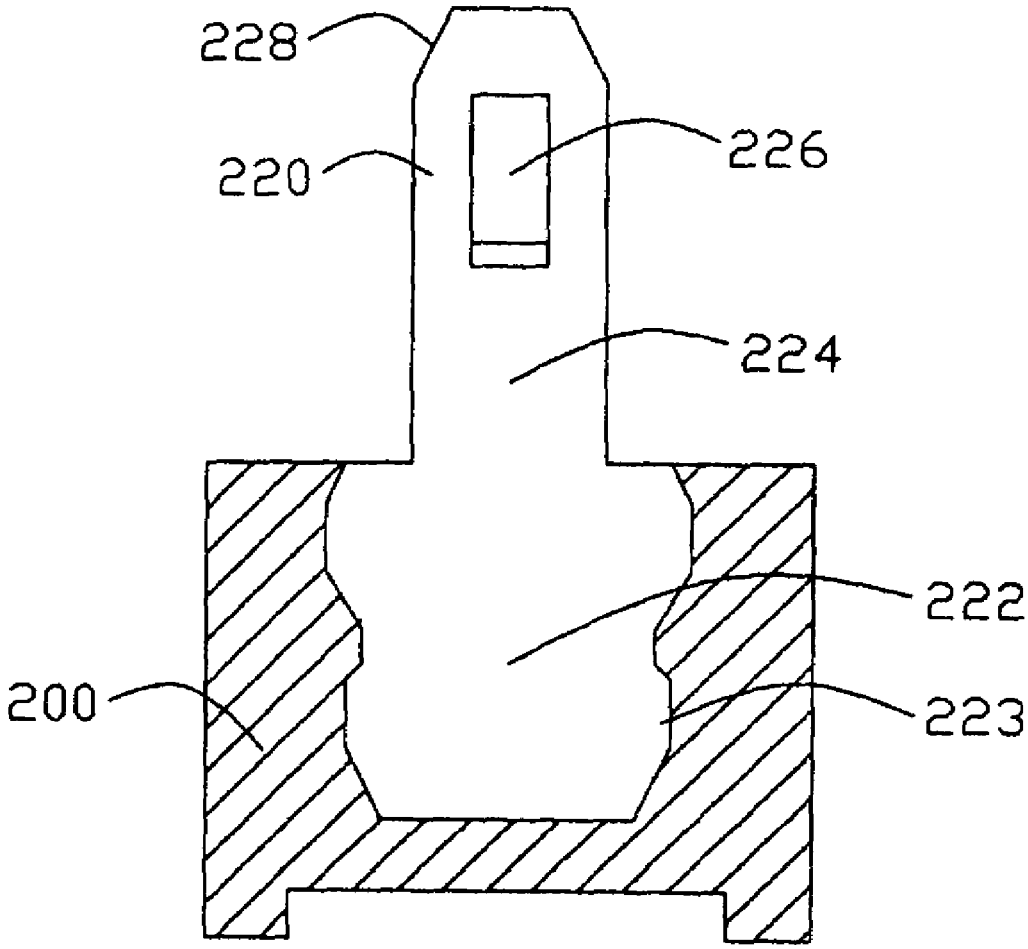
FIG. 5 depicts a cross sectional view of the electrical connector assembly of FIG. 1 taken in the direction of line 5—5.

Referring to FIGS. 4 and 5, a pair of hooks 202 are symmetrically arranged at the two recessed steps 202, respectively. The middle protruding platform 204 and the hook 202 extend in a same direction with respect to the recessed steps 202. The distance between a distal end of the hook 220 and the recessed steps 202 is slightly shorter than that between an end surface of the middle protruding platform 204 and the recessed steps 202.

The hooks 220 are stamped from a sheet of metal material having desirable flexibility and are preferably secured to the recessed steps 202 via insertion molding. Each hook 220 includes a retaining section 222 and a blade-shaped cantilevered arm 224 extending from an upper side of the retaining section 222 in a coplanar manner. A plurality of intervening barbs 223 is formed at two lateral sides of the retaining section 222 to securely retain the hook 220 in the first insulative housing 200. The cantilevered arm 224 is punched at a distal end thereof to form a clasping claw 226. One end of the clasping claw 226 is jointed to the cantilevered arm 224 and the other end of the clasping claw 226 is broken off from the cantilevered arm 224. Two corners of the cantilevered arm 224 are flattened to form a pair of guiding surfaces 228 thereat, in order to ensure smooth insertion of the hook 220 into a corresponding holding trough 306 defined in the second insulative housing 300.

It should be understood that the clasping claws 226 can also be formed via other manners. For example, in an alternative form, the clasping claws 226 can be formed via bending a distal end of the cantilevered arm 224 backward toward the retaining section 222. In addition, the hooks 220 can also be secured to the recessed steps 202 by other means. For instance, in an alternative form, a pair of receiving slits is previously defined in the recessed steps 202. The hooks 220 are inserted into the corresponding receiving slits and retained in the receiving slits via intervention between the retaining section 222 and the receiving slits, respectively.

Referring also to FIG. 1, the second connector 30 includes a second insulative housing 300 and a plurality of second conductive terminals 320 residing in the second insulative housing 300 to mate with the corresponding first conductive terminals 210 of the first connector 20.

The second insulative housing 300 is also molded from electrically insulating material, such as resin or the like. The second insulative housing 300 includes a bottom wall 302 and a pair of lateral walls 304 extending upward from the bottom wall 302 along a same direction. The lateral walls 304 extend relative to the bottom wall 302 to a distance slightly longer than that between the middle protruding platform 204 and the recessed steps 202. The distance between the two lateral walls 304 is also slightly longer than the length of the middle protruding platform 204, so as to ensure safe mating of the first connector 20 and the second connector 30.

A plurality of second conductive terminals 320 is disposed on the bottom wall 302 in a matrix manner in compliance with that of the first conductive terminals 210. One end of each second conductive terminal 320 extends with respect to the bottom wall 302 along a same direction as that of the lateral walls 304 to contact with the corresponding first conductive terminals 210 of the first connector 20. The other end of the second conductive terminal 320 extends out of a connecting surface 303 of the second insulative housing 300, to be electrically connected to another circuit substrate (not shown).

Figure 3:
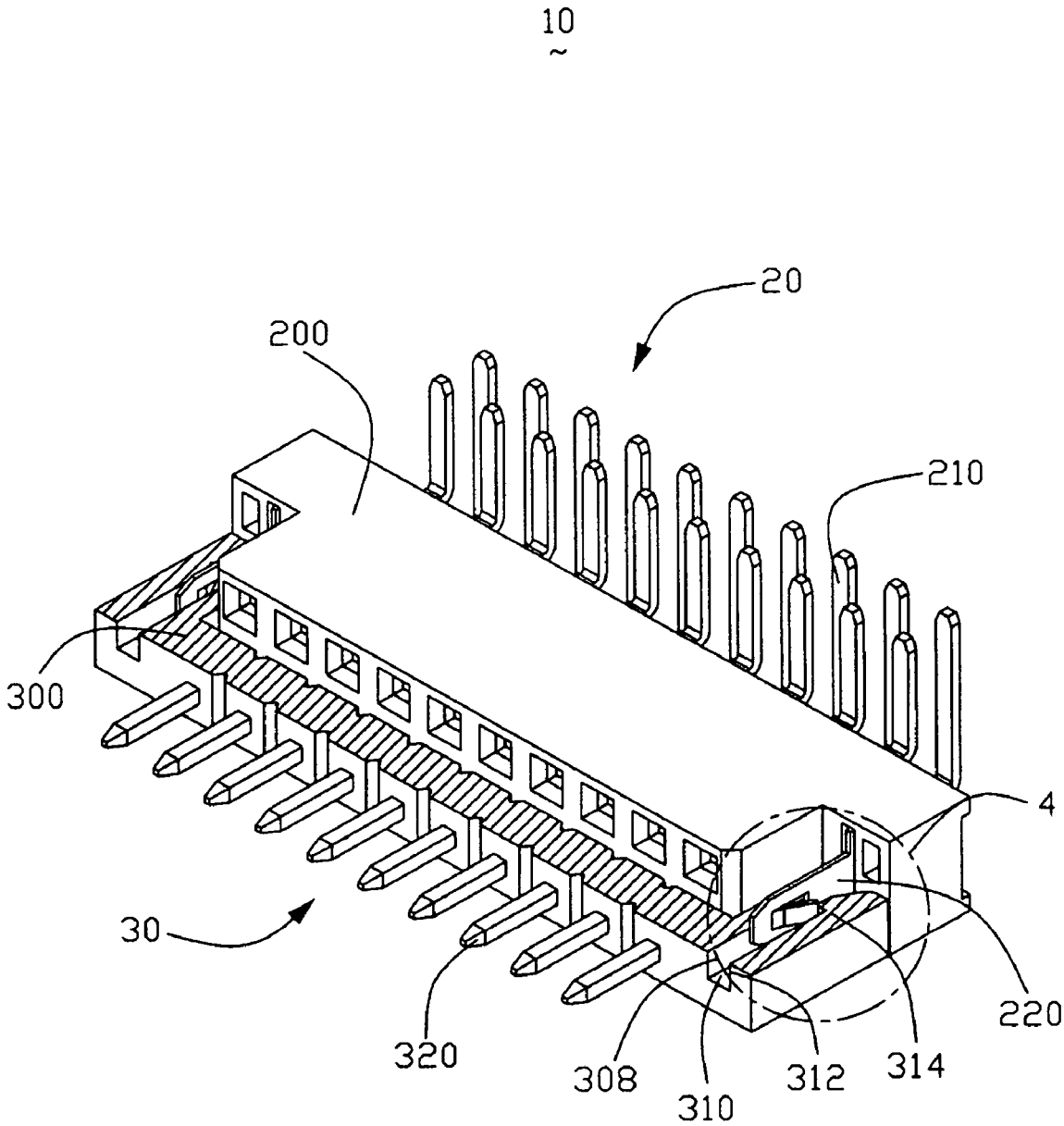
FIG. 3 depicts a partially cross-sectional view of the electrical connector assembly of FIG. 2, wherein part of the second connector is cut away to illustrate the engagement between a hook of the first connector and a protruding block of the second connector.

Referring to FIGS. 3 and 4, each of the lateral walls 304 is configured to have a predetermined width to define a holding trough 306 extending therethrough to receive a hook 220 of the first connector 20. The holding trough 306 is encircled by a resisting wall 308, a pair of sidewalls 310 and a contacting wall 312 opposite to the resisting wall 308.

A protruding block 314 extending from the contacting wall 312 toward the resisting wall 308 is formed at an upper side of the contacting wall 312. The protruding block 314 has a guiding slop 3140, a vertical wall 3142 parallel with the contacting wall 308, and a horizontal wall 3144 at a lower side of the vertical wall 3142. The distance between the vertical wall 3142 and the resisting wall 308 is slightly shorter than the distance between the distal end of the clasping claw 226 and the cantilevered arm 224 when the hook 220 is at a free state. The protruding block 314 is so configured to divide the holding trough 306 into an upper narrower chamber (not labeled) and a lower wider chamber (not labeled) communicating with each other.

Figure 2:
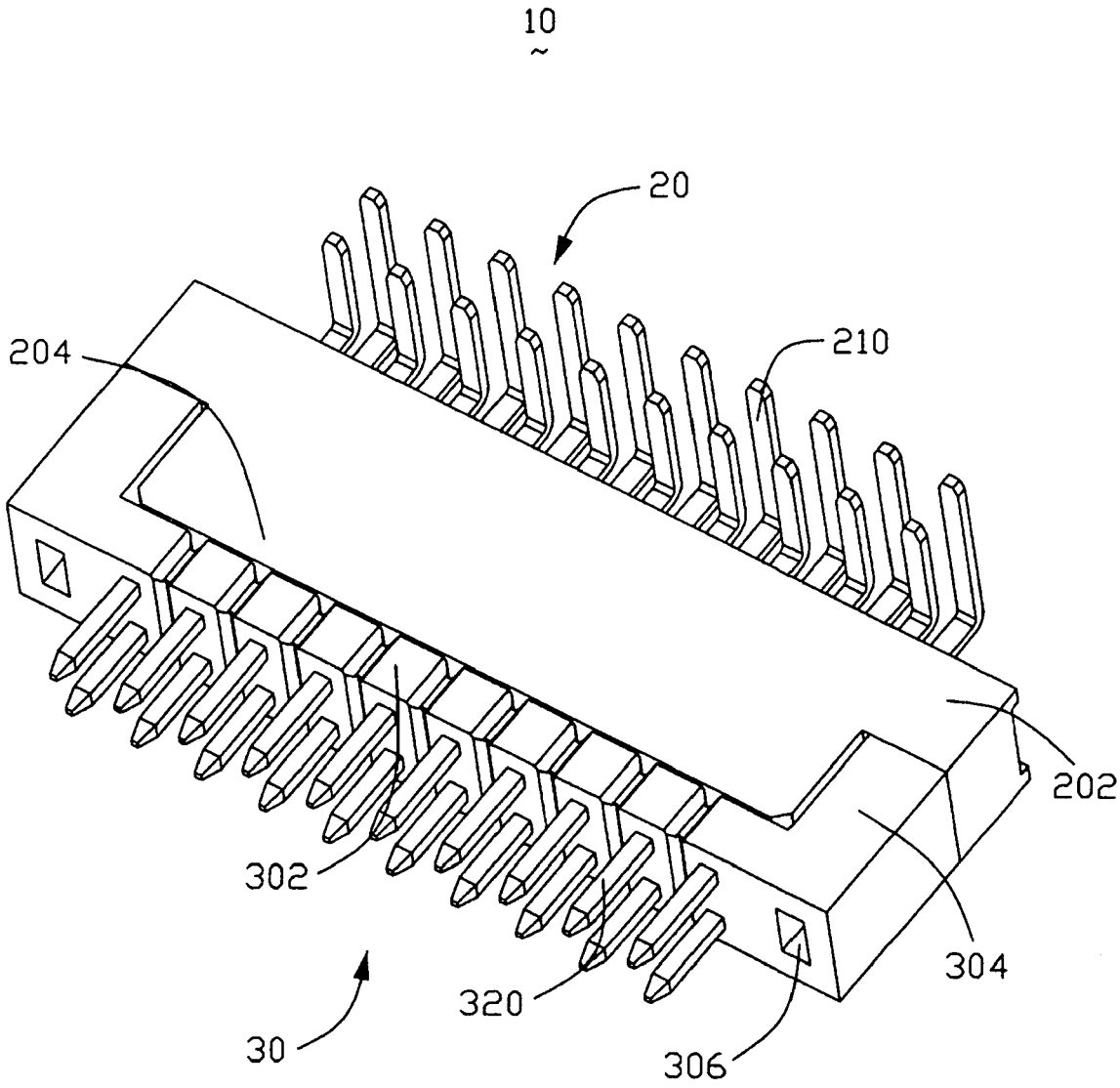
FIG. 2 depicts an assembled, isometric view of the electrical connector assembly of FIG. 1, showing the first connector being fully mated with the second connector.

Referring to FIGS. 1 to 3, prior to mating the first connector 20 with the second connector 30, the middle protruding platform 204 of the first connector 20 is positioned between the two lateral walls 304 of the second connector 30. The hooks 220 and the passages 206 are aligned with the corresponding holding troughs 306 and the second conductive terminals 320, respectively. The distal ends of the clasping claws 226 of the hooks 220 are in a free state.

As the first connector 20 is pressed to mate with the second connector 30, the middle protruding platform 204 slides along the lateral walls 304 toward the bottom wall 302. The hooks 220 are urged to slide along the resisting walls 308 and into the holding troughs 306. When the clasping claw 226 enters the upper narrower chamber between the resisting wall 308 and the vertical wall 3142, free end of the clasping claw 226 is pressed to resiliently swing toward the cantilevered arm 224.

When the first connector 20 is fully mated with the second connector 30, the first conductive terminals 210 are brought to contact with the corresponding second conductive terminals 320. The clasping claw 226 of the hook 220 reverts to the free state via elastic deformation, with the distal end thereof abuts against the horizontal wall 3144 of the protruding block 314. Therefore, the clasping claw 226 is safely held in the lower wider chamber. The first connector 20 is in secure engagement with the second connector 30 and free from disengaging from the second connector 30. Stable electrical connection between the first connector 20 and the second connector 30 is ensured.

While the present invention has been illustrated by the description of a preferred embodiment thereof, and while the preferred embodiment has been described in considerable detail, it is not intended to restrict or in any way limit the scope of the appended claims to such details. Additional advantages and modifications within the spirit and scope of the present invention will readily appear to those skilled in the art. Therefore, the present invention is not limited to the specific details and illustrative examples shown and described.

What is claimed is:

1. An electrical connector assembly comprising:

a first connector comprising a first insulative housing planted with a plurality of first conductive terminals, the first insulative housing being provided with a pair of hooks at two sides thereof; and a second connector to mate with the first connector comprising a second insulative housing having a plurality of second conductive terminals for contacting with the corresponding first conductive terminals of the first connector, the second insulative housing defined with a passage having a pair of protruding blocks interlocked with the hooks so as to safely lock the hooks when the first connector is fully mated with the second connector.

2. The electrical connector assembly of claim 1, wherein each hook of the first connector comprises a retaining section and a cantilevered arm extending from the retaining section in a coplanar manner, and a resilient clasping claw is formed at a distal end of the cantilevered and to clasp the protruding block.

3. The electrical connector assembly of claim 2, wherein the resilient clasping claw of the hook is formed via punching a distal end of the cantilevered arm, with one end of the resilient clasping claw being jointed to the cantilevered arm and the other end of the resilient clasping claw broken off from the cantilevered arm.

4. The electrical connector assembly of claim 2, wherein the resilient clasping claw of the book is formed via bending a distal end of the cantilevered arm backward toward the retaining section.

5. The electrical connector assembly of claim 2, wherein the retaining section of the hook is formed with a plurality of intervening barbs at two lateral sides thereof.

6. The electrical connector assembly of claim 1, wherein the second insulative housing of the second connector comprises a pair of lateral walls each defining a holding trough, and the protruding block is formed at an upper side of the holding trough.

7. The electrical connector assembly of claim 6, wherein each holding trough extends throughout the lateral wall of the second insulative housing.

8. The electrical connector assembly of claim 6, wherein each holding trough comprises an upper narrow chamber and a lower wider chamber in communication with each other.

9. An electrical interconnection comprising:

a first connector comprising a first body embedded with a plurality of first conductive terminals, the first body being provided a pair of clasping posts each having a resilient barb at an end thereof; and a second connector to mate with the first connector comprising a second body having a plurality of second conductive terminals to contact with the first conductive terminals, the second body comprising a pair of lateral walls each defining a receiving slots in compliance with the clasping posts, the receiving slots each extends throughout the lateral walls of the second body, and each of the receiving slots defining an upper narrow chamber and a lower wider chamber in communication with each other;

wherein during the mating of the first connector and the second connector, the resilient barb is pressed to run through the upper narrower chamber and successively reverts to a free state in the lower wider chamber so as to securely lock the first connector to the second connector.

10. The electrical interconnection of claim 9, wherein the clasping posts of the first connector is disposed in the first body via insertion molding.

11. The electrical interconnection of claim 9, wherein the resilient barbs is formed via punching a distal end of the clasping post, with one end of the resilient barb being jointed to the clasping post and the other end of the resilient barb broken off from the clasping post.

12. The electrical interconnection of claim 9, wherein the resilient barbs is formed via bending a distal end of the clasping post.

13. The electrical interconnection of claim 9, wherein the clasping posts each forms a plurality of intervening protrusions at two lateral sides thereof to firmly retain the clasping posts in the first body.

14. The electrical interconnection of claim 9, wherein the clasping posts is stamped from a metal material having desirable flexibility.

15. An electrical connector assembly comprising:

a first connecting including a first insulative housing with a plurality of first terminals therein;

a second connector including a second insulative housing with a plurality of second terminals therein;

the first connector including at least a deflectable extending forward hook;

the second connector including a locking wall located the around an end of a holding trough which extends forwardly from a rear end surface of the second housing;

said hook locked to said locking wall under a condition that a front portion of the hook including a locking head at a free end thereof, is protectively hidden in the second housing.

16. The electrical connector assembly as claimed in claim 15, wherein the front portion of the hook does not extend beyond a front face of the first housing of the first connector.

17. The electrical connector assembly as claimed in claim 15, wherein the front portion of the hook is located beside and laterally aligned with a mating port of the first connector.

18. The electrical connector assembly as claimed in claim 17, wherein a locking head is essentially located at the end of the holding trough.

* * * * *